US005579667A

United States Patent [19]

Kim

[11] Patent Number: 5,579,667

[45] Date of Patent: Dec. 3, 1996

[54] ADJUSTABLE WRENCH

[76] Inventor: Kwang-Moo Kim, 755-3, Kyomoon-Dong, Koori, Kyunggi-Do, Rep. of Korea

[21] Appl. No.: 450,352

[22] Filed: May 25, 1995

[30] Foreign Application Priority Data

| | | | |
|---|---|---|---|
| Jan. 6, 1995 | [KR] | Rep. of Korea | 95-74 |
| Jan. 28, 1995 | [KR] | Rep. of Korea | 95-1431 |
| Apr. 3, 1995 | [KR] | Rep. of Korea | 95-6617 |

[51] Int. Cl.[6] ..... B25B 13/58

[52] U.S. Cl. ..... 81/185.1; 81/178; 81/423; 269/276

[58] Field of Search ..... 81/421–424, 178, 81/185.1; 269/261, 272, 276, 279, 280, 283

[56] References Cited

U.S. PATENT DOCUMENTS

| | | | |
|---|---|---|---|
| 953,346 | 3/1910 | Newbauer | 81/178 X |
| 1,018,528 | 2/1912 | Suddarth | 81/178 |
| 1,531,377 | 3/1925 | Clarke | 81/178 X |
| 3,179,430 | 4/1965 | Zierden | 81/185.1 X |
| 3,247,742 | 4/1966 | Woodbury | 81/185.1 X |
| 4,569,511 | 2/1986 | Bell, Jr. | 269/276 |
| 5,243,883 | 9/1993 | Savage | 269/276 X |

FOREIGN PATENT DOCUMENTS

| | | |
|---|---|---|
| 851175 | 6/1985 | Rep. of Korea . |
| 863147 | 11/1986 | Rep. of Korea . |

*Primary Examiner*—D. S. Meislin
*Attorney, Agent, or Firm*—Barbara A. Fisher

[57] ABSTRACT

An adjustable wrench having at least one size-adjusting block on its head is disclosed. The adjusting block includes an eccentric fitting member that is, an eccentric fitting column or an eccentric fitting hole. The eccentric fitting means is eccentrically provided on the block such that the horizontal distances between the fitting member and the side surfaces of the block are different from each other. With the eccentric fitting member of the size-adjusting block, the grip size of the wrench head is easily adjusted by simply changing the fitting direction of the block relative to the head. The wrench head of this wrench may be integrally formed with the wrench handle or separately formed from the wrench handle.

9 Claims, 11 Drawing Sheets

ADJUSTABLE WRENCH

BACKGROUND OF THE INVENTION

1. Field of the Invention

The present invention relates in general to adjustable wrenches commonly used in tightening and loosening different-sized bolts and nuts and, more particularly, to a structural improvement in such adjustable wrenches for facilitating use of the wrenches for tightening or loosening the bolts and nuts of different sizes by changeable fitting of size-adjusting blocks with eccentric fitting means in a wrench head.

2. Description of the Prior Art

With reference to FIG. 1, there is shown a typical wrench used in tightening or loosening a bolt and nut, which wrench is provided with opposed heads 52 and 52' integrated with both ends of a wrench handle 55 into the wrench. Each of the heads 52 and 52' has a pair of fixed jaws 50 or 50', thus to form a grip opening 51 or 51' between the jaws 50 or 50'. However, as the grip openings 51 and 51' of the above wrench have fixed grip sizes, the wrench is inevitably limited in its use. Therefore, the above wrench has a problem that a variety of wrenches of different sizes should be prepared for selective use of wrenches in tightening or loosening a corresponding variety of bolts and nuts of different sizes. As a variety of wrenches of different sizes should be prepared as described above, the wrenches may be lost and increase the cost.

In order to counter the above problems of the wrench having a fixed grip size, there have been proposed adjustable socket wrenches as disclosed in Korean U.M. Publication Nos. 85-1175 and 86-3147. FIG. 2 shows an example of the typical adjustable socket wrenches. As shown in the drawing, the typical adjustable socket wrench includes a head 60 coupled to an end of a handle 65 by means of a shaft 61. The head 60 has an adjustable grip opening 62, which opening 62 is formed by a fixed jaw 60*a* and a movable jaw 60*b*. The movable jaw 60*b* is movable with respect to the fixed jaw 60*a* by a turning motion of an adjusting worm 64 so that the size of the grip opening 62 is adjusted and fitted to the head size of a bolt or nut to be tightened or loosened.

However, the above adjustable socket wrench has a problem that as the size of the grip opening 62 is adjusted by the turning motion of the adjusting worm 64, the adjusting worm 64 may be abraded or broken due to pressure repeatedly applied thereto whenever tightening or loosening bolts and nuts and this reduces durability of the wrench. Whenever tightening or loosening bolts and nuts of different sizes, the adjusting worm 64 should be turned in order to fit the size of the adjustable grip opening 62 to the size of bolt or nut. Therefore, the above wrench still has an inferior wrench work efficiency.

Additionally, the construction of above adjustable socket wrench is so complicated that the wrench is produced at high cost. Another problem of the above adjustable socket wrench resides in that the size of the grip opening 62 adjusted by moving the movable jaw 60*b* relative to the fixed jaw 60*a* is limited to a predetermined range so that the above adjustable socket wrench still has the problem of size limitation.

SUMMARY OF THE INVENTION

It is, therefore, an object of the present invention to provide an adjustable wrench in which the above problems can be overcome and whose head is provided with at least one size-adjusting block, which block includes eccentric fitting means and is detachably fitted in the wrench head and facilitates use of the wrench for tightening or loosening the bolts and nuts of different sizes by changeable fitting of the block in the head.

In order to accomplish the above object, the present invention provides an adjustable wrench having a wrench head of a grip size, wherein the improvement comprises: at least one size-adjusting block detachably fitted in the wrench head in order to adjust the grip size of the head, the block having an eccentric fitting means for detachably fitting the block in the wrench head while adjusting the grip size of the head, the eccentric fitting means being eccentrically provided on the block such that horizontal distances between the fitting means and the side surfaces of the block are different from each other, the grip size of the head being adjustable by changing the fitting direction of the block relative to the head.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 5:
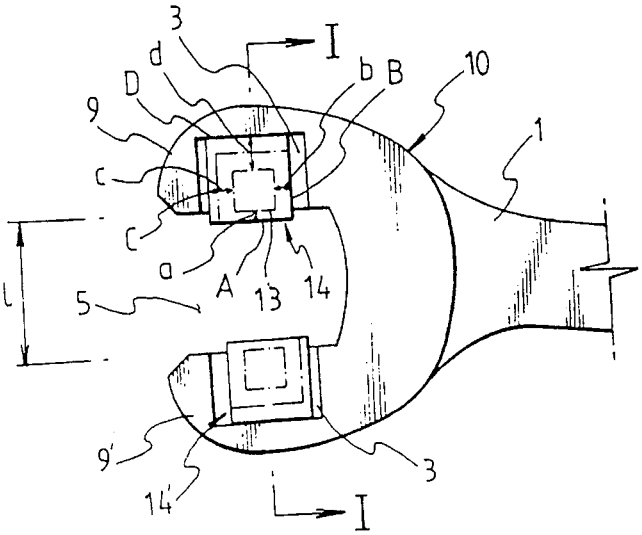
FIG. 5 is a plan view of the wrench of FIG. 4, showing an example of fitted positions of the size-adjusting blocks relative to the head.

With reference to the accompanying drawings, there are shown adjustable wrenches in accordance with different embodiments of the present invention. As shown in the drawings, the wrench of the invention is provided with a head 10, which head 10 may be integrally formed with a handle 1 of the wrench. Of course, it should be understood that the wrench head and the wrench handle may be separately formed and detachably coupled to each other by, for example, a coupling shaft into the wrench. The wrench head 10 is provided with size-adjusting means, comprising at least one size-adjusting block 14, 14', 28, 28'. Each size-adjusting block 14, 14', 28, 28' has eccentric fitting means 13, 27 for detachably fitting the block into a block receiving means 3 of the wrench head 10. In each size-adjusting block 14, 14', 28, 28', the fitting means 13, 27 is eccentrically formed on the block body such that the horizontal distances from the means 13, 27 to the side surfaces or the support surfaces A, B, C and D of the block body are different from each other. For example, the fitting means 13 of the block 14 is eccentrically formed on the block body such that the horizontal distances a, b, c and d from the side surfaces of the means 13 to the side surfaces A, B, C and D of the block body are different from each other as shown in FIG. 5. With the eccentricity of the fitting means 13, 27 relative to the block body, the width of a grip opening 5, 5*a*, 5*b* of the head 10 can be easily adjusted by simply changing the fitting direction of the block 14, 14', 28, 28' relative to block receiving means 3 of the wrench head 10, thus to be fitted to the size of a head of bolt or nut to be tightened or loosened.

In the embodiments of FIGS. 3 to 6, the size-adjusting block 14, 14' has the fitting means 13, comprising a rectangular column 13*a* and an enlarged holding plate 13*b* mounted to the end of the column 13*a*, while at least one of both jaws 9 and 9' of the head 10 for forming the grip opening 5 is provided with the block receiving means or a recess 3 for receiving the size-adjusting block 14, 14'. The recess 3 comprises a rectangular block seat 3*a*, a rectangular notch 3*b* and a bottom recess 3*c*. In the recess 3, the block seat 3*a* is for receiving the cubic body of the block 14, 14', the notch 3*b* is formed in the bottom of the seat 3*a* and detachably receives the column 13*a*, and the bottom recess 3*c* is formed on the bottom surface of the jaw and holds the holding plate 13*b* of the block 14, 14'.

Planted in the bottom of the block seat 3*a* of the recess 3 is a permanent magnet P. With the magnet P, the size-adjusting block 14, 14', 28, 28' typically made of magnetizable metal is magnetically attracted to the magnet P when the block 14, 14', 28, 28' is seated in the recess 3. Therefore, the fitted state of the block 14, 14', 28, 28' in the recess 3 is stabilized such that the block 14, 14', 28, 28' is not suddenly separated from the head 10 as far as the block 14, 14', 28, 28' is not forcibly separated from the head 10.

Of course, when the block 14, 14', 28, 28' is made of a nonferrous metal which is not magnetizable, the block 14, 14', 28, 28' is provided with a permanent magnet (not shown), which magnet is planted in a portion corresponding to the magnet P of the recess 3 and whose polarity is opposed to that of the magnet P such that the block 14, 14', 28, 28' can be magnetically attracted to the magnet P when the block 14, 14', 28, 28' is seated in the recess 3.

In the embodiments of FIGS. 3 through 6, the wrench heads 10 are the same as each other in that the fitting means 13 of the size-adjusting block 14, 14' comprises the rectangular column 13*a* and the holding plate 13*b* mounted to the end of the column 13*a*, and the recess 3 of the head 10 comprises the rectangular block seat 3*a*, the rectangular notch 3*b* and the bottom recess 3*c*. However, the wrench heads 10 of these embodiments are different in that the wrench head 10 according to the first embodiment of FIG. 3 has only one recess 3 formed in the jaw 9, while the wrench head 10 according to the second embodiment of FIGS. 4 through 6 has opposed recesses 3 formed in the jaws 9 and 9', respectively.

Figure 1:
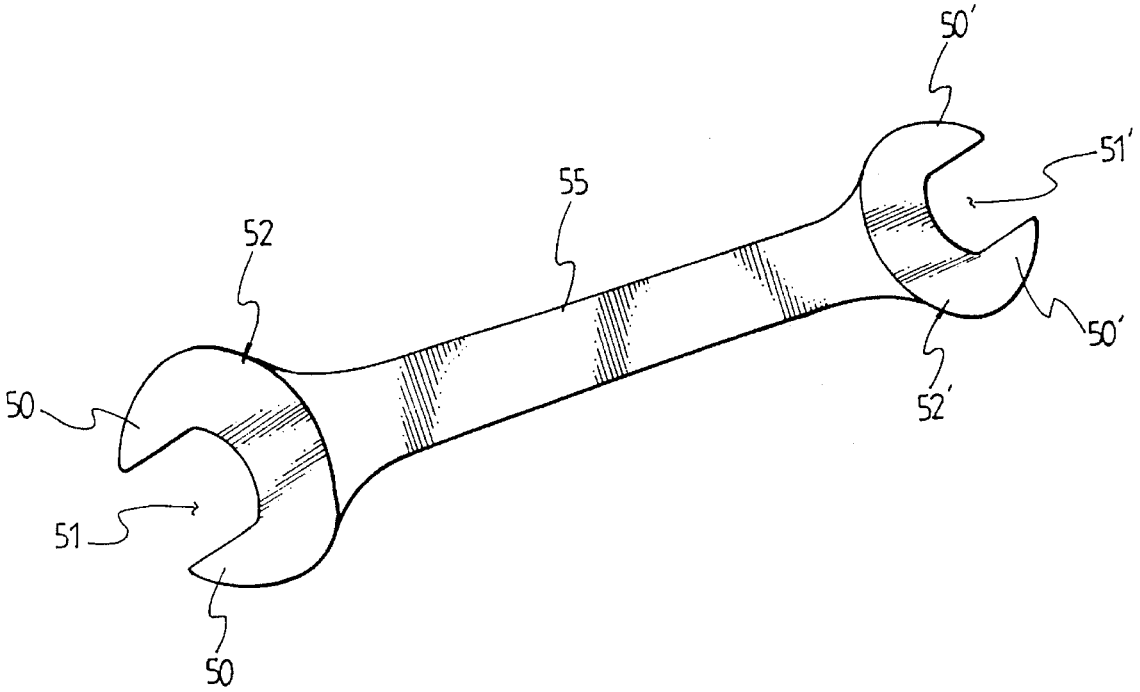
FIG. 1 is a plan view of a typical wrench with opposed heads having fixed jaws.
Figure 2:
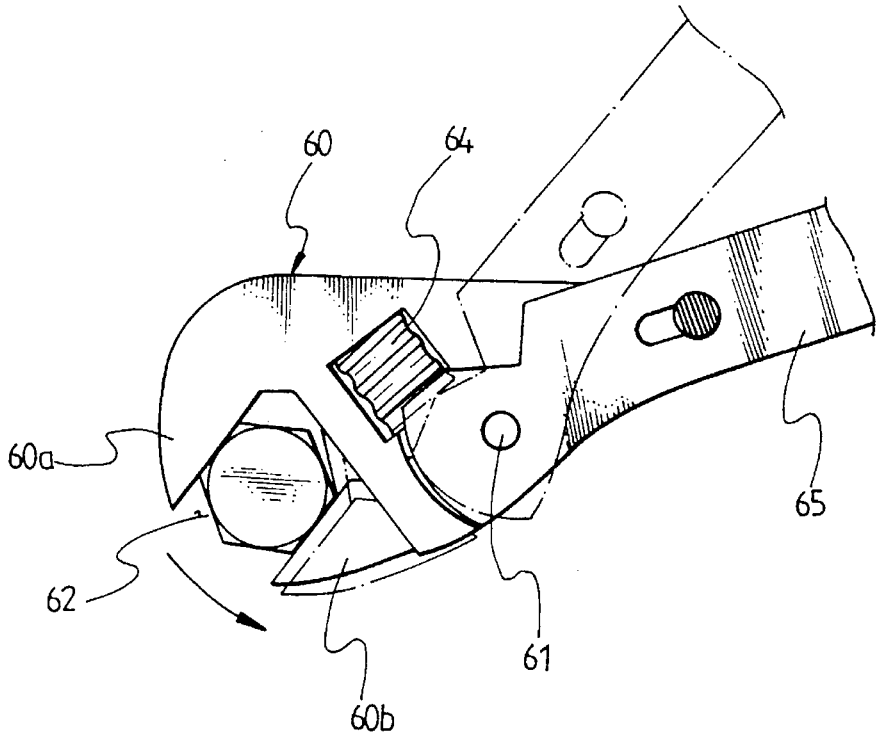
FIG. 2 is a partial plan view of a typical adjustable socket wrench with a fixed jaw and a movable jaw moved by turning motion of an adjusting worm.
Figure 3:
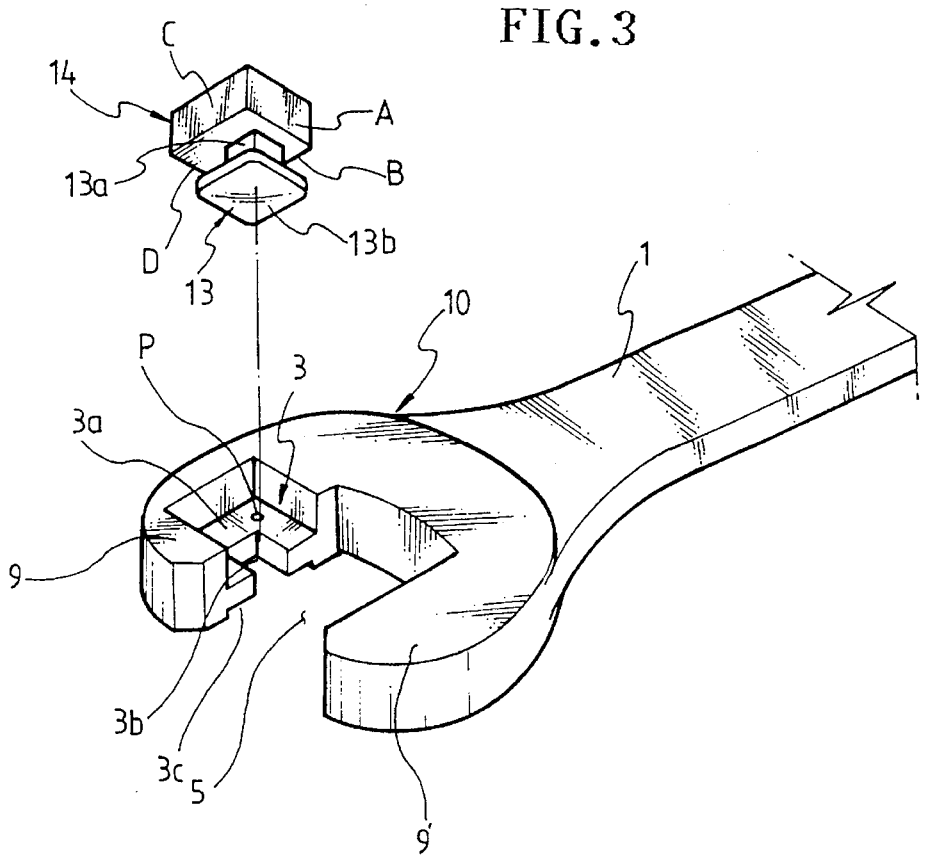
FIG. 3 is an exploded perspective view of an adjustable wrench having one size-adjusting block provided in one jaw of the wrench head in accordance with a first embodiment of the present invention.
Figure 4:
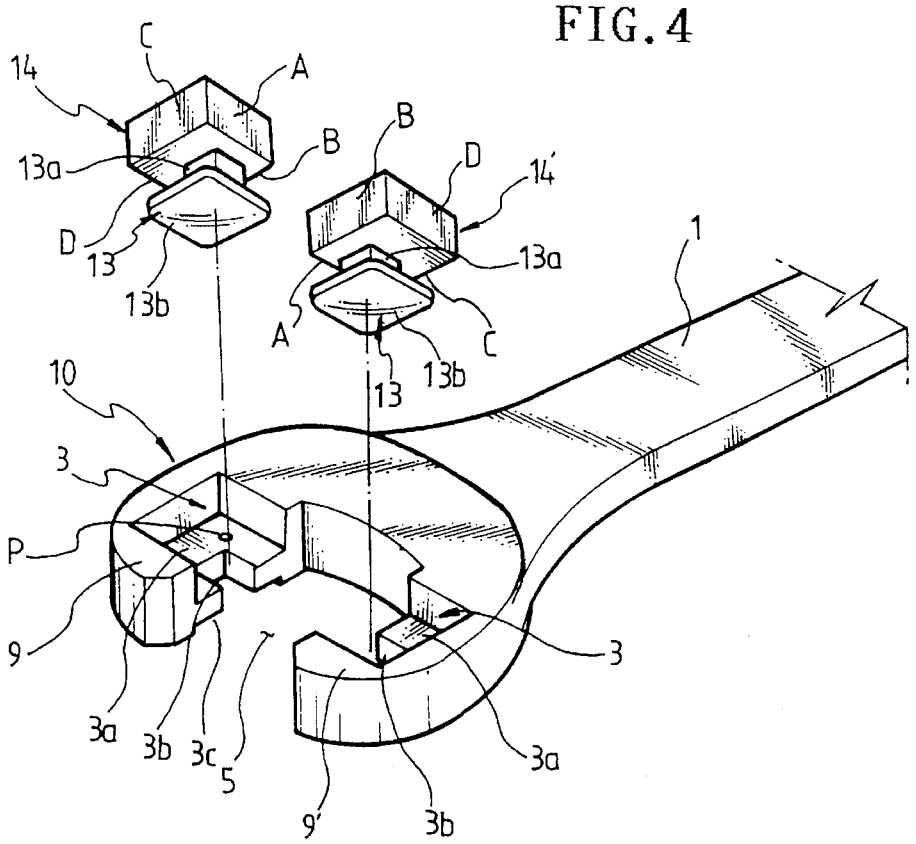
FIG. 4 is an exploded perspective view of an adjustable wrench having the size-adjusting block provided in each jaw of the wrench head in accordance with a second embodiment of the present invention.
Figure 6:
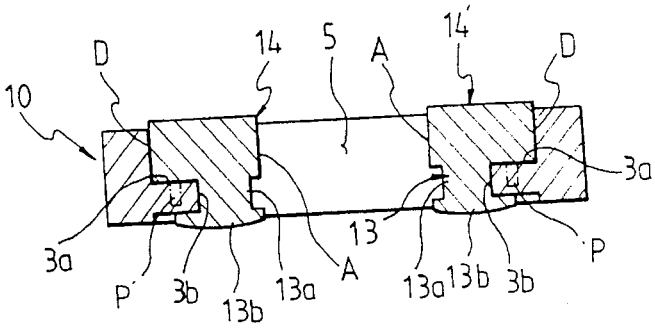
FIG. 6 is a sectional view of the wrench of the second embodiment taken along the section line 6—6 of FIG. 5.
Figure 7:
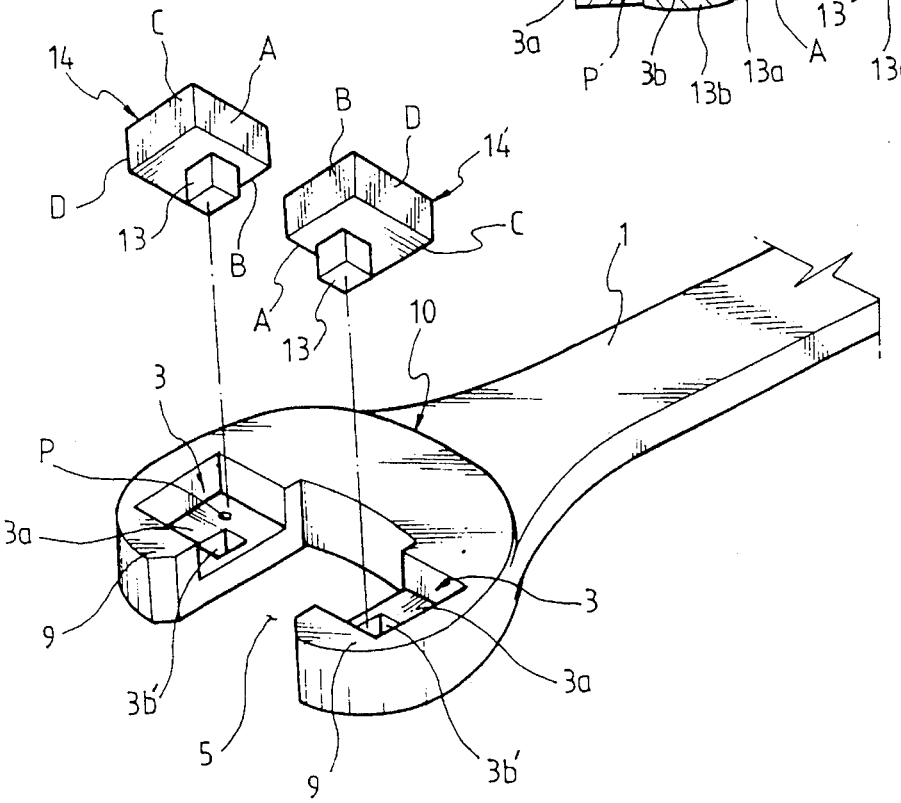
FIG. 7 is a view corresponding to FIG. 4, but showing another embodiment of the wrench head having fitting slots instead of fitting notches of FIG. 4.
Figure 8:
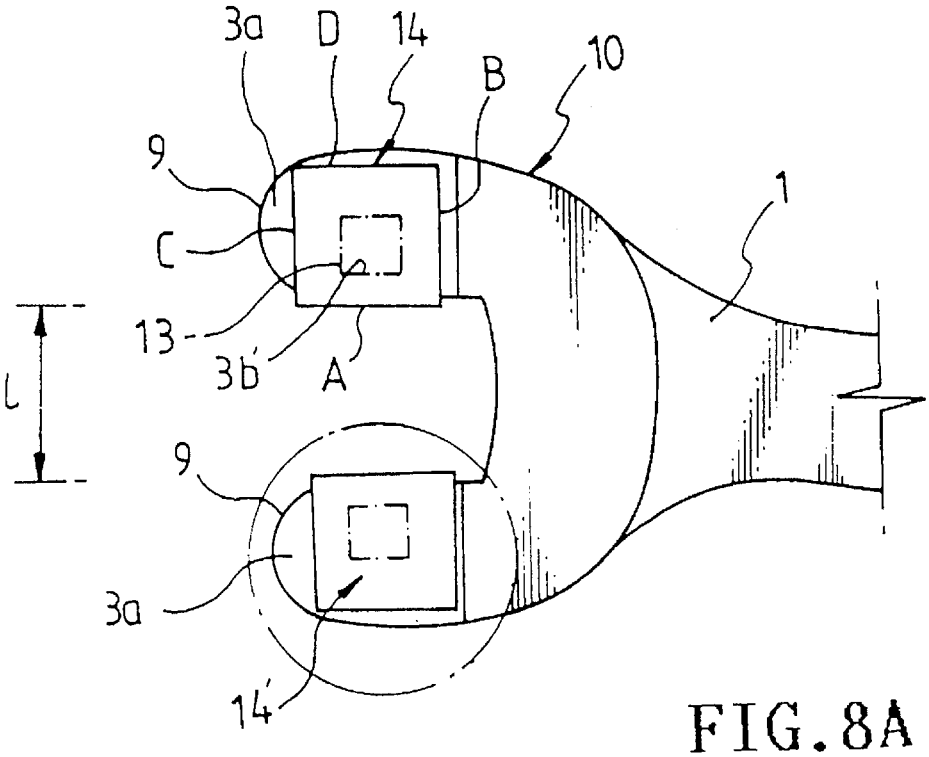
FIG. 8 is plan view of another embodiment of means for receiving the size-adjusting block of the wrench of FIG. 7.
Figure 8A:
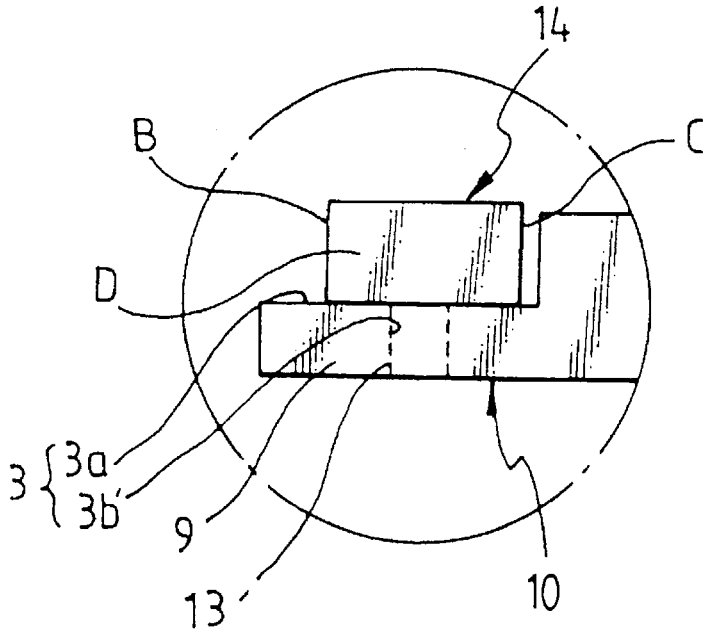
FIG. 8A is a front view of the block receiving means of FIG. 8.

In the embodiments of FIGS. 7, 8 and 8A, the wrench heads 10 of these embodiments have opposed recesses 3 formed in the jaws 9 respectively in the same manner as described for the second embodiment of FIGS. 4 to 6. The wrench heads 10 of these embodiments are the same as each other in that the fitting means 13 of the size-adjusting block 14, 14' comprises a rectangular column, and the recess 3 of the head 10 comprises a rectangular block seat 3*a* and a rectangular slot 3*b'*. However, these wrench heads 10 are different from each other in that the block seats 3*a* of the wrench head 10 according to the embodiment of FIG. 7 are partially formed on the jaws 9, while the block seats 3*a* of the wrench head 10 according to the embodiment of FIGS. 8 and 8A are entirely formed over the jaws 9.

Figure 9:
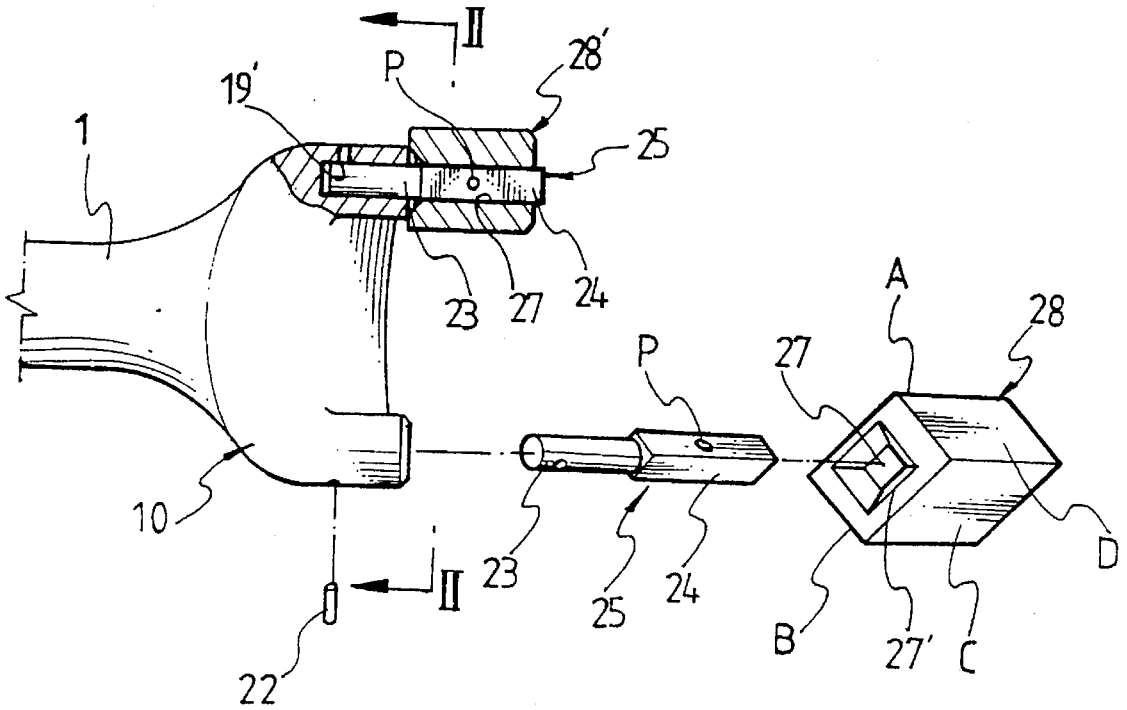
FIG. 9 is an exploded perspective view of an adjustable wrench having size-adjusting blocks fitted in the jaws of the wrench head through fitting columns in accordance with a third embodiment of the invention.
Figure 10:
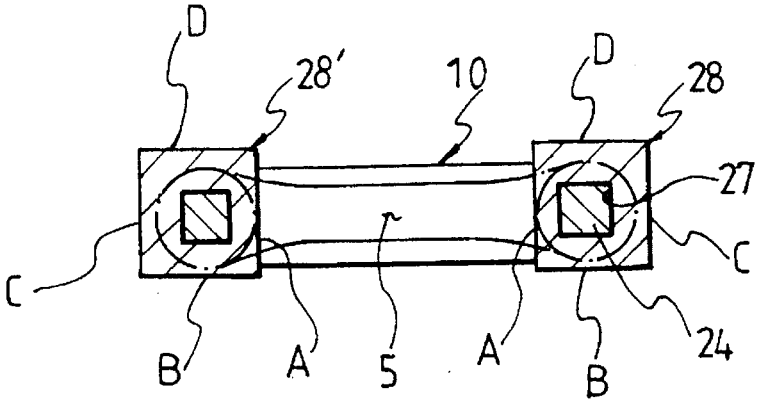
FIG. 10 is a sectional view of the wrench of the third embodiment taken along the section line II—II of FIG. 9.

Turning to FIGS. 9 and 10, there is shown the wrench according to a third embodiment of the invention. In the third embodiment, the eccentric fitting means of each size-adjusting block 28, 28' is a polygonal hole 27, while a column 25 as the block receiving means is provided in at least one of the opposed jaws of the wrench head 10, which column 25 partially has an outer appearance corresponding to the configuration of polygonal hole 27 of the block 28, 28'.

The column 25 as the block receiving means of the wrench head 10 comprises a polygonal part 24 and a cylindrical part 23. The polygonal part 24 is for engaging with the polygonal hole 27 of the block 28, 28' and has an outer appearance corresponding to the configuration of polygonal hole 27, while the cylindrical part 23 is for engaging with an associated jaw of the head 10. In order to fit the cylindrical part 23 of the column 27 in the wrench head 10, the associated jaw of the head 10 is provided with a cylindrical hole 19'. When fitting the column 25 in the wrench head 10, the cylindrical part 23 of the column 25 is inserted in the cylindrical hole 19' of the head 10 and, thereafter, fixed to the hole 19' by a radial fixing pin 22.

In this third embodiment, it is preferred to plant a permanent magnet P in the polygonal part 24 of the column 25 as shown in FIG. 9. The permanent magnet P has the same functional effect as described for the magnet P of the above embodiments of FIGS. 3 through 7.

Figure 11:
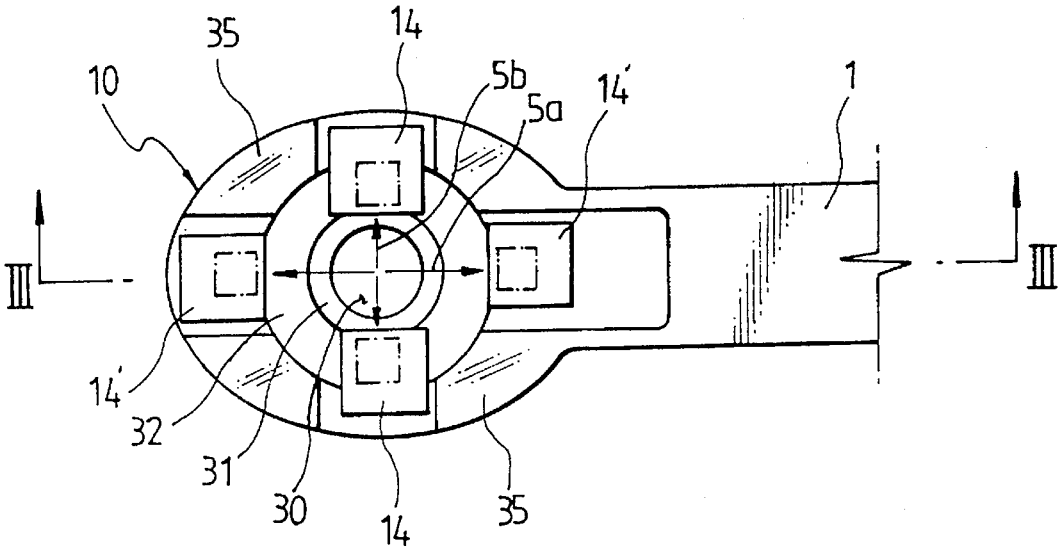
FIG. 11 is a bottom view of a wrench head of an adjustable socket wrench in accordance with a fourth embodiment of the invention.
Figure 12:
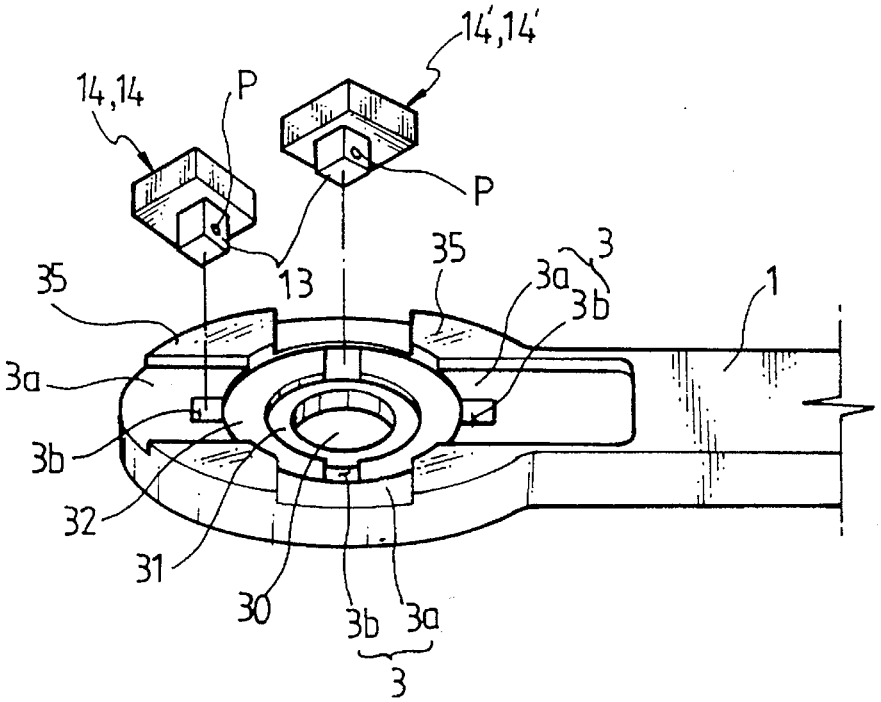
FIG. 12 is an exploded perspective view of the wrench head of FIG. 11.
Figure 13:
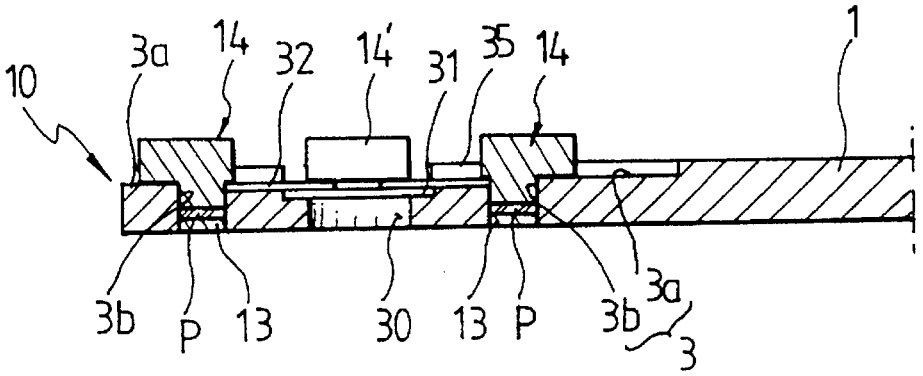
FIG. 13 is a sectional view of the wrench of the fourth embodiment taken along the section line 13—13 of FIG. 11.

Referring next to FIGS. 11 through 13, there is shown a socket type wrench provided with the size-adjusting blocks in accordance with another embodiment of the invention. In this embodiment, the socket wrench includes four size-adjusting blocks 14 and 14', which blocks 14 and 14' are detachably fitted in the wrench head 10 such that the blocks 14 and 14' are regularly spaced out at right angles. The eccentric fitting means of each size-adjusting block 14, 14' is the rectangular column 13, while the bottom of the head 10 having the grip openings 5*a* and 5*b* has four recesses 3 for receiving the size-adjusting blocks 14 and 14', respectively. Each recess 3 comprises a rectangular seat 3*a* and a rectangular slot 3*b*. In each recess 3, the seat 3*a* is for receiving the cubic body of an associated block 14, 14', while the slot 3*b* detachably receives the column 13 of the block 14, 14'. In the head 10 of this wrench, four shoulders 35 are provided between the regularly spaced seats 3*a*. A side step of each shoulder 35 can come into contact with the side surface D of the block body of an associated block 14, 14' so that the side step stops the side surface D of the block 14, 14' when the block 14, 14' is applied with twisting moment during tightening or loosening of bolts or nuts. The horizontal distance "d" between the column 13*a* of fitting means 13 and the side surface D of the block 14 or 14' is the longest distance of the horizontal distances a, b, c and d defined between the column 13 and the side surfaces A, B, C and D of the block 14 or 14' as shown in FIG. 5.

The center of the head 10 is concentrically recessed twice such that inner and outer annular steps 31 and 32 are concentrically formed in the inside of the seats 3*a* as shown in FIG. 12. In the recesses 3, two fitting slots 3*b* opposed to each other are formed in the outside of the outer annular step 32 or in their associated seats 3*a* so that those slots 3*b* are named as outside slots. Therefore, when the size-adjusting blocks 14' are fitted in the outside slots 3*b* as shown in FIG. 10, the grip opening 5*b* defined between the blocks 14' fitted in the outside slots 3*b* can a relatively large-sized bolt or nut. On the contrary, the other slots 3*b* opposed to each other and spaced apart from the above outside slots 3*b* at right angles are formed in the outer annular step 32 so that these slots 3*b* are named as inside slots. Therefore, when the size-adjusting blocks 14 are fitted in the inside slots 3*b* as shown in FIG. 11, the grip opening 5*a* defined between the blocks 14 fitted in the inside slots 3*b* can a relatively small-sized bolt or nut.

Figure 14:
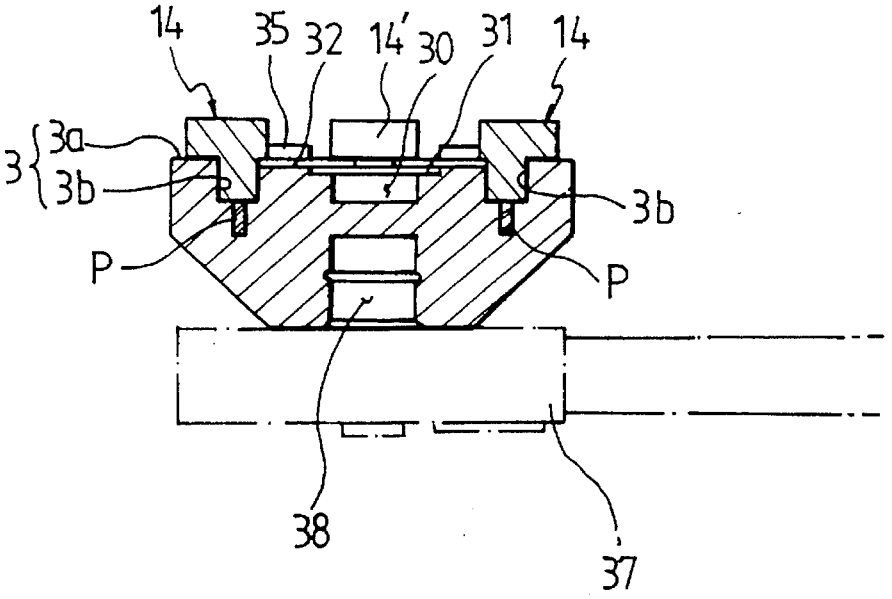
FIG. 14 is a view corresponding to FIG. 13, but showing a separate-type wrench head having the size-adjusting blocks on its bottom surface in accordance with a fifth embodiment of the invention.

Turning to FIG. 14, there is shown a separate type of adjustable wrench provided with the size-adjusting blocks 14 and 14' in accordance with another embodiment of the invention. In this embodiment, the wrench has the construction for fitting the size-adjusting blocks 14 and 14' to the recesses 3 of the wrench head 10 in the same manner as that described for the embodiment of FIGS. 11 through 13. However, the wrench head 10 of this embodiment is separately formed from the handle 1 differently from the wrench of FIGS. 11 to 13. The wrench head 10 of this embodiment is provided at its center with a handle coupling hole 38 for coupling the wrench head 10 to a typical separate wrench handle 37. In this wrench head 10, the permanent magnets P are planted in the bottoms of the polygonal slots 3*b* respectively.

When using the above wrench, the size-adjusting blocks 14 or 14' are fitted in associated recesses 3 of the wrench head 10 in the same manner as described for the embodiment of FIGS. 11 through 13. Of course, the wrench head 10 of this embodiment should be coupled to the typical wrench handle 37 through a coupling shaft.

Figure 15:
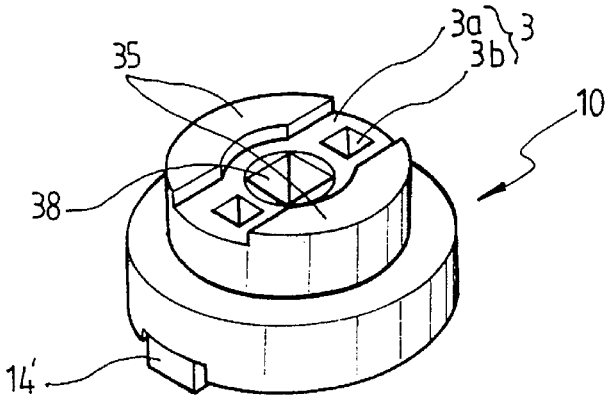
FIG. 15 is a perspective view of a separate-type wrench head having the size-adjusting blocks on either of its top and bottom surfaces in accordance with a sixth embodiment of the invention.
Figure 16:
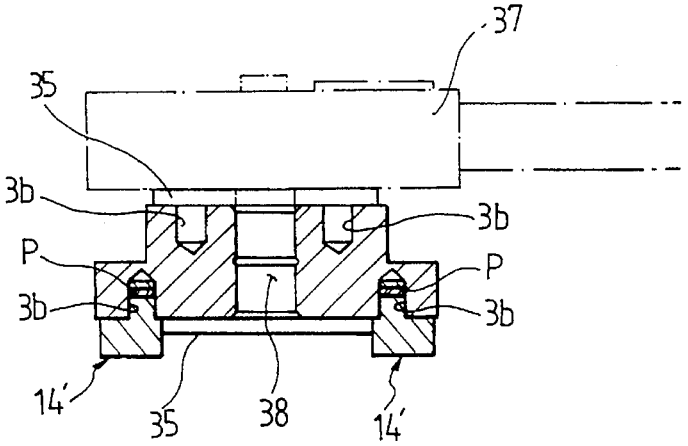
FIG. 16 is a sectional view of the wrench head of FIG. 15, showing an example of use of the wrench head.
Figure 17:
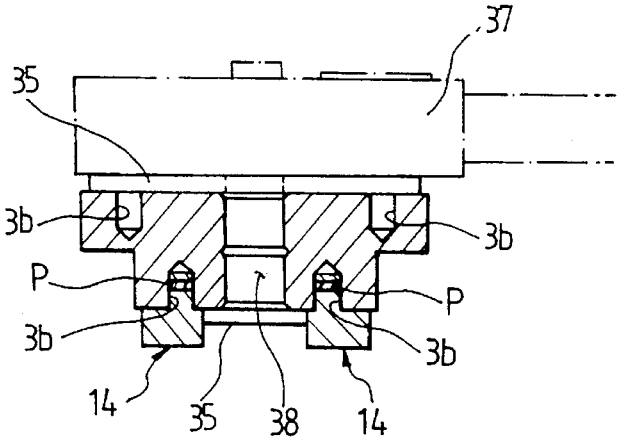
FIG. 17 is a view corresponding to FIG. 16, but showing another example of use of the wrench head.

Referring next to FIGS. 15 through 17, there is shown a separate type of adjustable wrench in accordance with still another embodiment of the invention. In this embodiment, the wrench head 10 is separately formed from the wrench handle 1 in the same manner as described for the wrench of FIG. 14. Differently from the embodiment of FIG. 14, this wrench head 10 includes a pair of recesses 3, which recesses 3 are formed on each of the top and bottom surfaces of the head 10 such that the recesses 3 of each surface of the head 10 are opposed to each other. The recesses 3 have their fitting slots 3*b* for engaging with the fitting means 13 of the blocks. The recesses 3 formed on each surface of the head 10 receive their associated size-adjusting blocks 14 or 14'. The wrench head 10 of this embodiment is provided with a handle coupling through hole 38, which hole 38 is vertically formed in the center of the head 10 such that the hole 38 vertically extends from the top surface to the bottom surface of the head 10.

When using the above wrench head 10 of FIG. 15, the pair of size-adjusting blocks 14 or 14' are fitted in the recesses 3 provided on either surface of the head 10. The wrench head 10 having the blocks 14 or 14' on either surface thereof is, thereafter, coupled at the other surface thereof to the typical wrench handle 37 by means of a coupling shaft passing through the coupling through hole 38 as shown in FIGS. 16 and 17.

In the drawings, the reference numeral 27' of FIG. 9 denotes a taper part of the fitting hole 27 of each size-adjusting block 28, and the numeral 30 of FIG. 11 denotes a center through opening of the wrench head 10.

Hereinbelow, the operational effect of the adjustable wrench of the invention will be described.

Figure 18A:
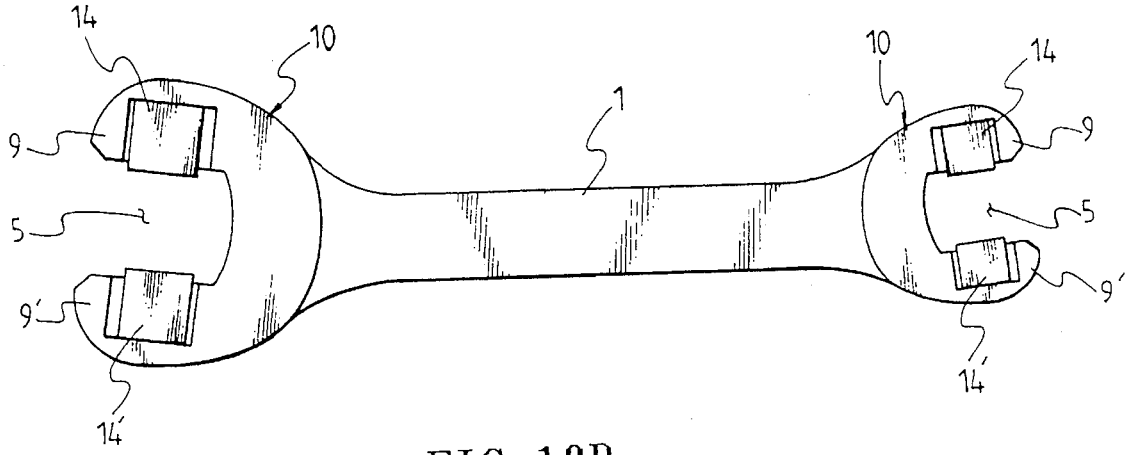
FIGS. 18A to 18C are schematic views of wrenches provided with the size-adjusting blocks in accordance with the embodiments of the invention respectively.
Figure 18B:
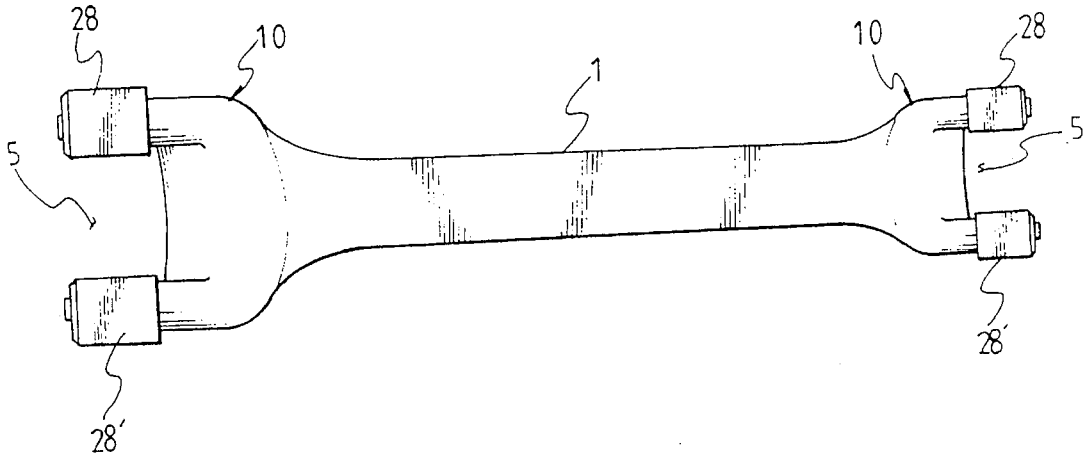
Figure 18C:
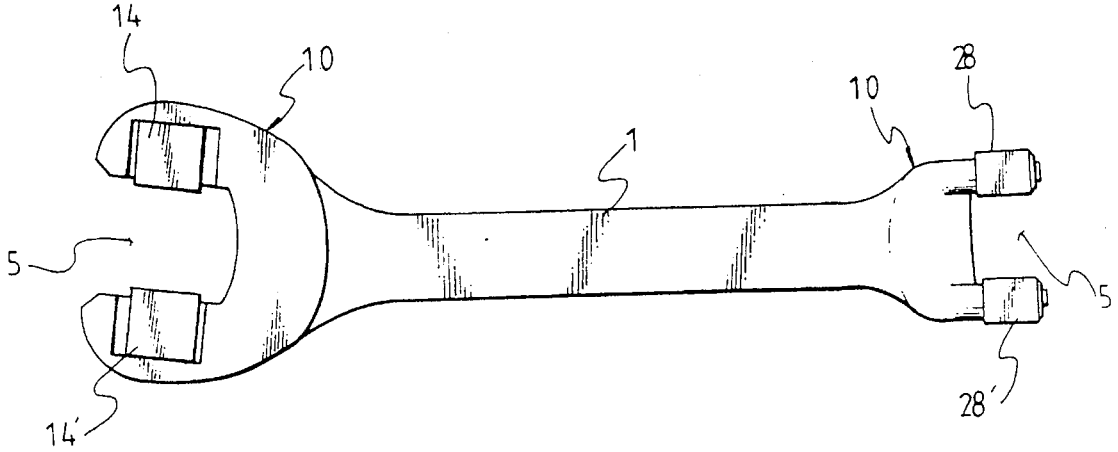

Use of the size-adjusting blocks of the invention in the wrench are various as shown in FIGS. 18A through 18C. In the embodiments of FIGS. 3 through 7, the heads 10 are integrally formed with opposed ends of the handle 1 and two pairs of size-adjusting blocks 14 and 14' of different sizes are fitted in the opposed heads 10 respectively as shown in FIG. 18A. In the embodiment of FIGS. 9 and 10, the heads 10 are integrally formed in opposed ends of the handle 1 and two pairs of size-adjusting blocks 28 and 28' of different sizes are fitted in the opposed heads 10 respectively as shown in FIG. 18B.

Of course, it should be understood that the pair of size-adjusting blocks 14 and 14' of FIGS. 3 through 7 and the pair of size-adjusting blocks 28 and 28' of FIGS. 9 and 10 may be commonly used in a wrench. That is, the heads 10 are integrally formed in opposed ends of the handle 1 of the wrench, and the pair of size-adjusting blocks 14 and 14' are fitted in the jaws of one head 10 and the pair of size-adjusting blocks 28 and 28' are fitted in the jaws of the other head 10 as shown in FIG. 18C.

In the embodiment of FIGS. 11 through 13, the socket wrench head 10 with the size-adjusting blocks 14 and 14' may be formed in either end of the handle 1. Of course, both ends of the handle 1 may be provided with the socket wrench heads 10 with the blocks 14 and 14' of FIGS. 11 through 13. On the other hand, the wrench head 10 of FIG. 14 and the wrench head 10 of FIGS. 15 through 17 are coupled to the typical wrench handles 37 through shafts, respectively.

The adjustable wrenches of the invention can be preferably used for tightening or loosening a variety of bolts and nuts of different sizes as follows.

In the following description, the wrench with the size-adjusting blocks 14 and 14' according to the embodiment of FIGS. 4 through 6 will be used, for example.

Figure 19A:
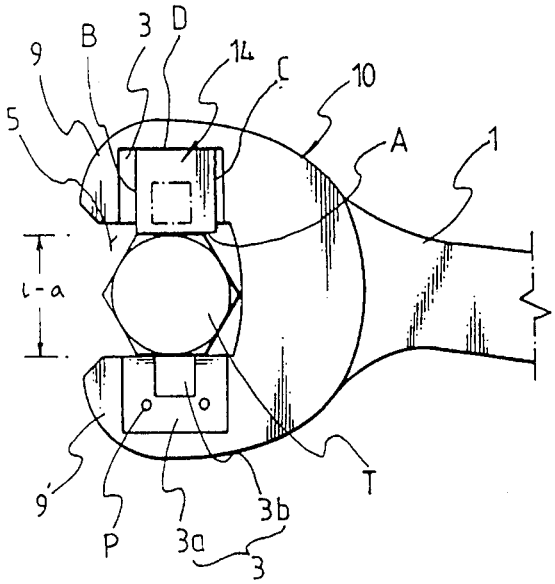
FIGS. 19A to 19H are schematic views of the wrench heads of the adjustable wrenches of FIG. 4, respectively, showing changeable directions of the size-adjusting blocks fitted in the wrench head.

In order to use the above wrench for tightening or loosening the bolts or nuts, the size-adjusting blocks 14 and 14' are fitted in the wrench head 10 such that the grip opening 5 of the wrench head 10 has a size equal to the size of bolt or nut to be tightened or loosened. In each size-adjusting block 14 or 14', the horizontal distances a, b, c and d between the column 13*a* of the eccentric fitting means 13 and the side surfaces A, B, C and D of the block body of each block 14 or 14' are different from each other as shown in FIG. 5. Therefore, when one size-adjusting block 14 is fitted in one of the jaws 9 of the head 10 such that the side surface A, having the shortest horizontal distance, of the block body of the block 14 is directed to the grip opening 5 as shown in FIG. 19A, the size or the width of the grip opening 5 of the head 10 will become l-a so that this wrench having the grip opening 5 of the size l-a can be used for tightening or loosening a bolt or nut of the size of l-a. Please noted that the alphabet l denotes the original size of the grip opening 5 defined by the fixed jaws 9 with no block 14, 14'. Of course, it should be understood that the size of grip opening 5 may become l-b, l-c or l-d in accordance with the direction of the block 14 fitted in the head 10.

Figure 19B:
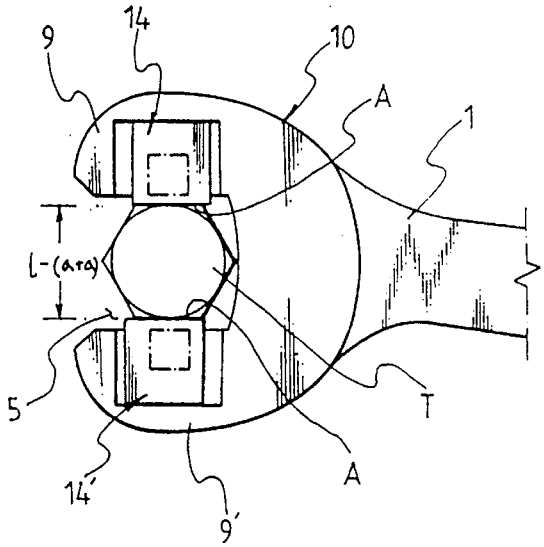
Figure 19C:
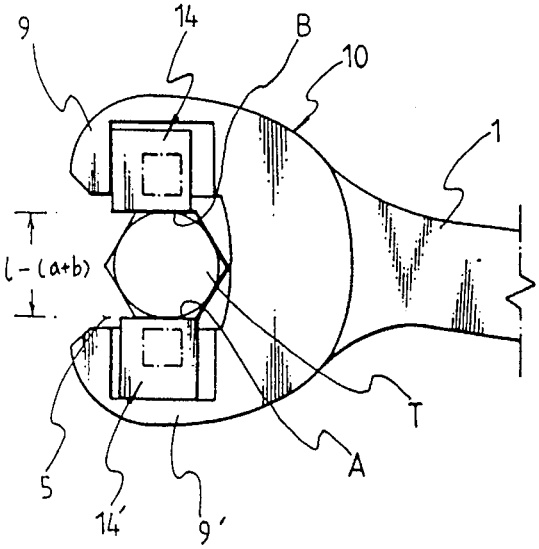
Figure 19D:
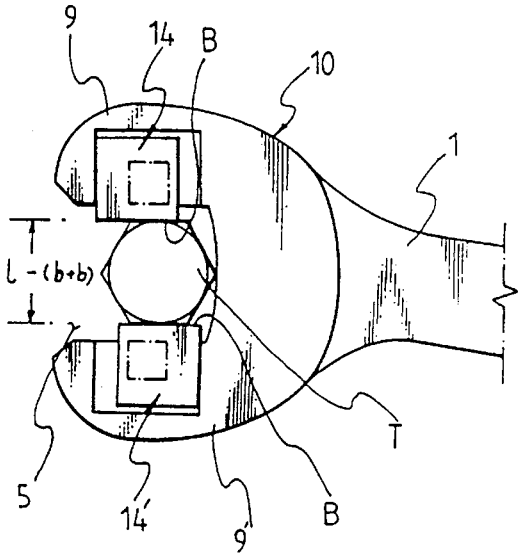
Figure 19E:
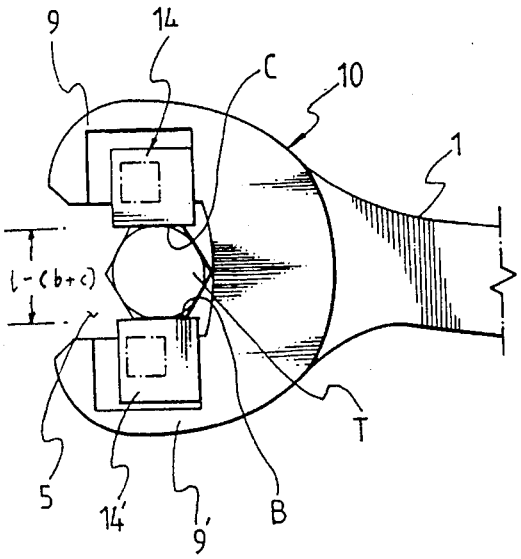
Figure 19F:
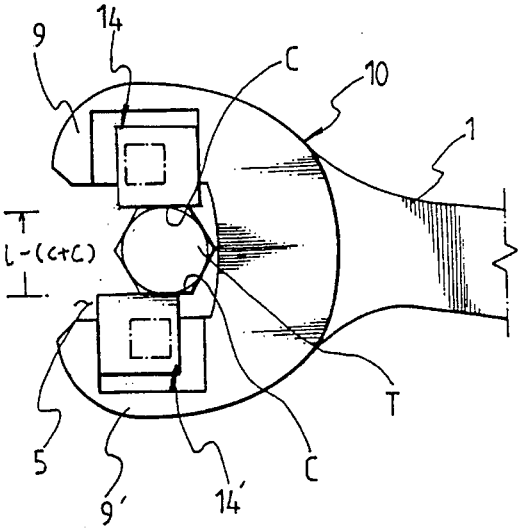
Figure 19G:
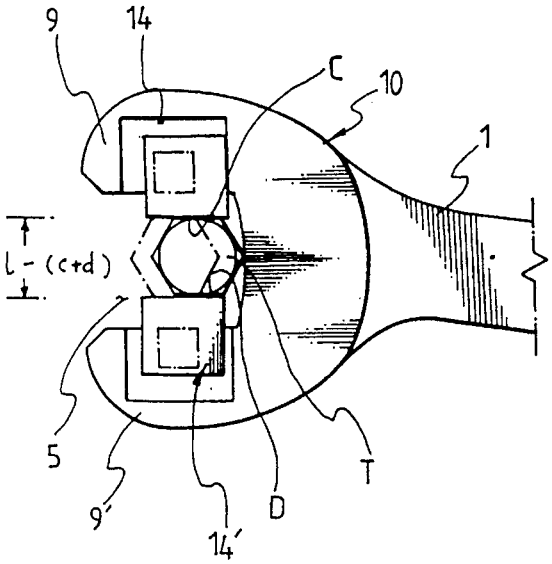
Figure 19H:
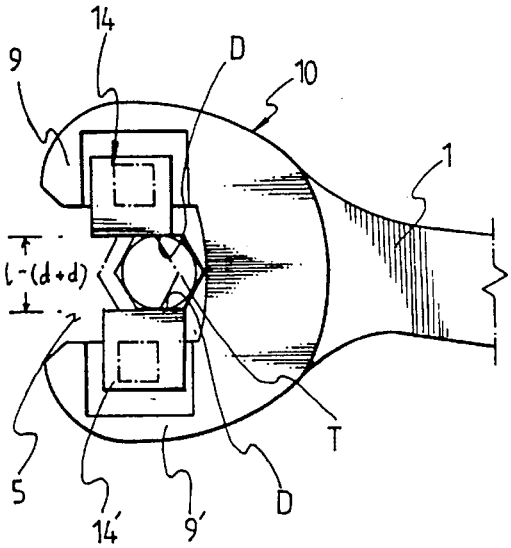

In the examples of FIGS. 19B through 19H, two size-adjusting blocks 14 and 14' are commonly fitted in the jaws 9 of a head 10 respectively in order to adjust the size of the grip opening 5 of the head 10. In this case, the size of the grip opening 5 of the head 10 can be freely adjusted in accordance with a direction of the blocks 14 and 14' fitted in the jaws 9 of the head 10. That is, when the two blocks 14 and 14' are fitted in the jaws 9 of the head 10 such that all the side surfaces A of the two blocks 14 and 14' are directed to the grip opening 5 as shown in FIG. 19B, the size of the grip opening 5 will become l-2*a*. When the two blocks 14 and 14' are fitted in the jaws 9 such that the side surface B of the block 14 and the side surface A of the block 14' are directed to the grip opening 5 as shown in FIG. 19C, the size of the grip opening 5 will become l-(a+b). When the two blocks 14 and 14' are fitted in the jaws 9 such that all the side surfaces B of the blocks 14 and 14' are directed to the grip opening 5 as shown in FIG. 19D, the size of the grip opening 5 will become l-2*b*. When the two blocks 14 and 14' are fitted in the jaws 9 such that the side surface C of the block 14 and the side surface B of the block 14' are directed to the grip opening 5 as shown in FIG. 19E, the size of the grip opening 5 will become l-(b+c). When the two blocks 14 and 14' are fitted in the jaws 9 such that all the side surfaces C of the blocks 14 and 14' are directed to the grip opening 5 as shown in FIG. 19F, the size of the grip opening 5 will become l-2*c*. When the two blocks 14 and 14' are fitted in the jaws 9 such that the side surface C of the block 14 and the side surface D of the block 14' are directed to the grip opening 5 as shown in FIG. 19G, the size of the grip opening 5 will become l-(c+d). When the two blocks 14 and 14' are fitted in the jaws 9 such that all the side surfaces D of the blocks 14 and 14' are directed to the grip opening 5 as shown in FIG. 19H, the size of the grip opening 5 will become l-2*d*. Of course, it should be understood that the size of grip opening 5 may become l-(a+c), l-(a+d) or l-(b+d) in accordance with the directions of the blocks 14 and 14' fitted in the head 10. In FIGS. 19A through 19H, the letter T denotes the bolt head or the nut to be tightened or loosened by the wrench.

When the blocks 14 and 14' are fitted in the head 10 of the wrench, the blocks 14 and 14' are magnetically attracted to the permanent magnets P planted in the recesses 3 of the head 10 so that the fitted state of the blocks 14 and 14' in the recesses 3 are more stabilized. The permanent magnets P also facilitate fitting and removing of the blocks 14 and 14' in and from the recesses 3 of the head 10. In addition, when the blocks 14 and 14' are fitted in the head 10, the side surfaces D of the blocks 14 and 14' come into contact with the side steps of the recesses 3 of the head 10 so that the side surfaces of the blocks 14 and 14' are stopped by the side steps of the recesses 3 when the blocks 14 and 14' are applied with the twisting moment during tightening or loosening of bolt or nut. Therefore, the wrench of the invention is provided with desired rigidity.

In the embodiment of FIGS. 9 and 10, the size-adjusting blocks 28 and 28' are fitted in the head 10 by fitting the polygonal hole 27 of blocks 28 and 28' over the columns 25 of the head 10, thus to form the grip opening 5 in the head 10. Therefore, the width of the head 10 is reduced so that this wrench is preferably used for tightening or loosening a small-sized bolt or nut. The horizontal distances between the hole 27 of the block 28, 28' and the side surfaces A, B, C and D of the block 28, 28' are different from each other in the same manner as described for the embodiments of FIGS. 3 through 7. Therefore, the size of the grip opening 5 of the head 10 can be simply adjusted by changing the fitting directions of the blocks 28 and 28' relative to the head 10.

In the embodiment of FIGS. 11 through 13, the size-adjusting blocks 14 and 14' are alternately fitted in the head 10 such that the blocks 14 and 14' are regularly spaced out at right angles. The blocks 14 and 14' of this embodiment define the grip openings 5*a* and 5*b* of the head 10. That is, the size of the first grip opening 5*a* can be adjusted by changing the fitting directions of the blocks 14, while the size of the second grip opening 5*b* can be adjusted by changing the fitting directions of the blocks 14', which blocks 14' are fitted in the opposed slots 3*b* formed in the outside of the outer annular step 32 of the head 10. With the two grip openings 5*a* and 5*b*, the adjustable sizes of the wrench according to the embodiment of FIGS. 11 through 13 are doubled compared to the embodiments of FIGS. 3 through 10.

In the embodiments of FIGS. 14 through 17, the size of the grip opening 5*a*, 5*b* of the head 10 can be freely adjusted by changing the fitting directions of the blocks 14, 14' relative to the head 10 in the same manner as described above.

As described above, the adjustable wrench of the invention includes at least one size-adjusting block. The size-adjusting block is fitted in a wrench head, which head may be integrally or separately formed with or from a wrench handle. The size-adjusting block includes eccentric fitting means for fitting the block in the head. In order to adjust the size of the grip opening of the head, the fitting means of the block is eccentrically formed on the block body such that the horizontal distances between the fitting means and the side surfaces of the block body are different from each other. The wrench head of the invention also includes block receiving means which will engage with the fitting means of the block. With the eccentric fitting means of the block, the grip size of the wrench according to the invention is easily adjusted by simply changing the fitting direction of the block relative to the head. Therefore, the adjustable wrench of the invention is commonly used for tightening or loosening different-sized bolts and nuts so that the wrench reduces cost and facilitates fitting and separation of the blocks in and from the head. This wrench also achieves desired rigidity.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An adjustable wrench having a wrench head of a grip size, comprising:

at least one size-adjusting block detachably fitted in said wrench head for adjusting the grip size of said head, said block having an eccentric fitting means for detachably fitting said block within the wrench head while adjusting the grip size of the head, said eccentric fitting means being eccentrically provided on said block such that horizontal distances between the fitting means and the side surfaces of said block are different from each other, said grip size of the head being adjustable by changing the fitting direction of said block relative to the head, wherein said eccentric fitting means of said block comprises a polygonal column; and said wrench head includes fixed jaws defining a grip opening therebetween, at least one of said jaws having block receiving means for receiving said block, said block receiving means comprising a block seat for seating a block body of said block therein and a polygonal opening formed in the bottom of said block seat for engaging with the polygonal column of said block.

2. An adjustable wrench having a wrench head of a grip size, comprising:

at least one size-adjusting block detachably fitted in said wrench head for adjusting the grip size of said head, said block having an eccentric fitting means for detachably fitting said block within the wrench head while adjusting the grip size of the head, said eccentric fitting means being eccentrically provided on said block such that horizontal distances between the fitting means and the side surfaces of said block are different from each other, said grip size of the head being adjustable by changing the fitting direction of said block relative to the head, wherein said eccentric fitting means of said block comprises a polygonal column and an enlarged holding plate mounted to the end of said column; and said wrench head includes fixed jaws defining a grip opening therebetween, at least one of said jaws having block receiving means for receiving said block, said block receiving means comprising a block seat for seating a block body of said block therein, a polygonal notch formed in the block seat and adapted for engaging with the polygonal column of said block, and a bottom recess formed on the bottom surface of the jaw and adapted for holding the holding plate of said block.

3. An adjustable wrench having a wrench head of a grip size, comprising;

at least one size-adjusting block detachably fitted in said wrench head for adjusting the grip size of said head, said block having an eccentric fitting means for detachably fitting said block within the wrench head while adjusting the grip size of the head, said eccentric fitting means being eccentrically provided on said block such that horizontal distances between the fitting means and the side surfaces of said block are different from each other, said grip size of the head being adjustable by changing the fitting direction of said block relative to the head, wherein said eccentric fitting means of said block comprises a polygonal column; and said wrench head includes fixed jaws defining a grip opening therebetween, at least one of said jaws having block receiving means for receiving said block, said block receiving means comprising a block seat for seating a block body of said block therein and a polygonal slot formed in the block seat and adapted for engaging with the polygonal column of said block.

4. The adjustable wrench according to any one of claims 1 to 3, further comprising a permanent magnet for magnetically attracting said block to said wrench head and stabilizing a fitted state of said block in the head, said permanent magnet being provided at least in either said eccentric fitting means of said block or said wrench head.

5. An adjustable wrench comprising:

a handle; and a head portion connected to said handle, said head portion including a grip opening formed in said head portion, eccentric fitting means for adjusting the size of the grip opening, means, formed in at least one side of said grip opening, for receiving said eccentric fitting means, and means for securing said eccentric fitting means within said means for receiving, wherein said eccentric fitting means is selectively positionable to obtain a corresponding plurality of grip opening sizes, and includes at least one size-adjusting block detachably fitted in said head portion, said eccentric fitting means being eccentrically mounted on said at least one block, respectively, such that horizontal distances between said fitting means and side surfaces of said block are different from each other, said grip opening of said head portion being adjustable by changing the fitting direction of said block relative to said head portion, and wherein said block includes a block body, a holding plate, and a polygonal column connecting the block body and the holding plate, and wherein said means for receiving includes a block seat for seating the block body of said block therein and a polygonal opening formed in the bottom of said block seat and adapted for engaging with the polygonal column of said block.

6. An adjustable wrench comprising:

a handle; and a head portion connected to said handle, said head portion including a grip opening formed in said head portion, eccentric fitting means for adjusting the size of the grip opening, means, formed in at least one side of said grip opening, for receiving said eccentric fitting means, and means for securing said eccentric fitting means within said means for receiving, wherein said eccentric fitting means includes at least one size-adjusting block detachably fitted in said head portion, said at least one size-adjusting block having a polygonal column and a block body, said eccentric fitting means being eccentrically mounted in said grip opening, such that horizontal distances between side surfaces of said at least one block are different from each other, said grip opening of said head portion being adjustable by changing the fitting direction of said at least one block relative to said head portion, and wherein said means for receiving includes a block seat for seating the block body of said block therein and a polygonal slot formed in the block seat and adapted for engaging with the polygonal column of said block.

7. The adjustable wrench according to claims 5 or 6, wherein said means for securing includes a permanent magnet for magnetically attracting said size-adjusting block to said head portion and stabilizing a fitted state of the block body within said head portion, said permanent magnet being provided at least in either said eccentric fitting means of the block or said head portion.

8. The adjustable wrench according to claims 5 or 6, wherein said grip opening is formed between a pair of opposing jaws.

9. The adjustable wrench according to claim 8, wherein said means for receiving is formed in at least one jaw of said pair of opposing jaws.

* * * * *